United States Patent [19]

Kunde et al.

[11] 4,258,557

[45] Mar. 31, 1981

[54] KNITTING MACHINE FOR PRODUCING KNITTED GOODS WITH COMBED-IN FIBRES

[75] Inventors: Klaus Kunde, Nürtingen; Klaus Schöffski, Stuttgart, both of Fed. Rep. of Germany

[73] Assignee: Sulzer Morate GmbH, Fed. Rep. of Germany

[21] Appl. No.: 945,017

[22] Filed: Sep. 22, 1978

[30] Foreign Application Priority Data

Nov. 2, 1977 [DE] Fed. Rep. of Germany ..... 2748941

[51] Int. Cl.[3] ..... D04B 9/14

[52] U.S. Cl. ..... 66/9 B; 19/106 R

[58] Field of Search ..... 19/106 R, 108; 66/9 B

[56] References Cited

U.S. PATENT DOCUMENTS

| | | | |
|---|---|---|---|
| 1,913,016 | 6/1933 | Walsh | 19/108 |
| 2,603,840 | 7/1952 | Dunn | 19/106 R |
| 2,953,002 | 9/1960 | Hill | 66/9 B |
| 3,019,623 | 2/1962 | Howes | 66/9 B |
| 3,159,881 | 12/1964 | Reiterer | 19/106 R |
| 3,563,058 | 2/1971 | Schmidt | 66/9 B |
| 3,709,002 | 1/1973 | Brandt et al. | 66/9 B |
| 3,896,637 | 7/1975 | Thore | 66/9 B |
| 4,006,609 | 2/1977 | Abler | 66/9 B |

FOREIGN PATENT DOCUMENTS

| | | | |
|---|---|---|---|
| 2524491 | 3/1977 | Fed. Rep. of Germany | 66/9 B |
| 177472 | 3/1922 | United Kingdom | 66/9 B |

*Primary Examiner*—Wm. Carter Reynolds

[57] ABSTRACT

The invention relates to a knitting machine having a combing-in cylinder for producing knitted goods with combed-in fibres. The problem of the invention is rapidly and effectively to eliminate the gaps which occur in the carding clothing of the combing-in cylinder in the knitting operation and which have only a very small number of fibres. This problem is solved by means of a regularization cylinder which co-operates with the combing-in cylinder and which treats the fibres on the combing-in cylinder in the manner of a comb, displaces such fibres in the opposite direction to the direction of rotation of the combing-in cylinder and thereby regularizes such fibres, without however picking up fibres itself.

7 Claims, 3 Drawing Figures

KNITTING MACHINE FOR PRODUCING KNITTED GOODS WITH COMBED-IN FIBRES

The invention relates to a knitting machine, in particular a knitting machine having knitting needles for producing knitted goods having combed-in fibres, including at least one rotatable combing-in cylinder which is provided with a carding clothing, a feed position at which fibres are laid into the carding clothing of the combing-in cylinder, a combing-in position at which fibres are taken from the carding clothing of the combing-in cylinder by the knitting needles, and at least one rotatable regularisation cylinder which also has a carding clothing, which co-operates with the combing-in cylinder, wherein the two carding clothings have resilient card wires with a bend, the card wires being in engagement along an engagement region.

With all known knitting machines of this kind, a major problem is that of producing a layer of fibres which is as uniform as possible. An obstacle to attaining a uniform layer of fibres is the fact that each knitting needle which is passed through the card wires of the carding clothing of the combing-in cylinder at the combing-in position leaves behind it an empty gap in which there are no fibres or only a comparatively small number of fibres. When at a later time the empty gap passes the feed position, the empty gap is charged with fibres in a different manner from those regions from which the needles took no fibres.

This problem occurs in a particular acute form in knitting machines for producing knitted goods with fibres which are combed into the article in accordance with a pattern. Indeed, when producing knitted goods of this kind, it is virtually impossible to offer each knitting needle, which is selected in accordance with the pattern, precisely that quantity of fibres which the knitting needle requires for forming a stitch with fibres combined therein. On the contrary, so that the fibres can be drawn from the needle hooks in the desired manner when the knitting needles are withdrawn, and bound into the stitch which is subseqently to be formed, the fibres must be laid on to the surface of the combing-in cylinder within a region of relatively large area, that is to say, for reasons involving the knitting process the combing-in cylinder must be supplied with a substantially greater supply of fibres than the amount which corresponds to the fibre requirement per stitch. A consequence of this is not only irregular fibre layers in the knitting but frequently also clearly visible negative patterns which have an ugly effect.

In order to solve the above-described problem, it is known for the amount of fibres which is fed to the combing-in cylinder to be controlled in accordance with the pattern (U.S. Pat. No. 3,709,002), that is to say, the quantity of fibres to be fed to the combing-in cylinder, at least on an average calculated over relatively short periods of time, is that amount which is consumed by the needles selected for the knitting operation. By control means of this kind, it is in fact possible to adapt the quantities of fibres fed to the combing-in cylinder, to the requirements of the knitting pattern, but it is not possible fully to eliminate the formation of gaps.

For the purposes of eliminating the above-mentioned irregularities, it is also known (U.S. Pat. No. 2,953,002) for a cleaning cylinder to be arranged after the combing-in position, as viewed in the direction of rotation of the combing-in cylinder. The cleaning cylinder is provided to free the combing-in cylinder of all the supply of fibres which remains thereon after a knitting needle has passed across the cylinder, and to re-introduce into the process in some manner the fibres which have been removed in this way, for example feeding the fibres directly to a card which is arranged upstream of the combing-in cylinder, or forming the fibres into a silver which can be fed to the above-mentioned card. It will be appreciated that, particularly in the production of patterned knitted goods, this suffers from the disadvantage either that the quantity of fibres fed to the combing-in cylinder also depends on the quantity of fibres which is returned by the cleaning roller and cannot therefore be precisely controlled, or that expensive additional devices are required to prepare and process the fibres which are removed by means of the cleaning cylinder.

Finally, it is already known for a regularisation means in the form of a respective working and turning cylinder or in the form of a carding plate to be associated with the combing-in cylinder (DOS No. 25 24 491). Means of this kind do in fact provide a certain degree of regularisation without modification of the supply of fibres on the combing-in cylinder, but generally they do not respond sufficiently quickly for irregularities in the fibre layer of the finished knitting or visible negative patterns to be completely avoided.

Therefore the invention is based on the problem of improving knitting machines of the kind set out above, in such a way that the empty gaps which are formed on the surface of the combing-in cylinder, being produced by the knitting needles selected for knitting process, are eliminated as rapidly and effectively as possible.

The invention, therefore, is characterized in that the relative spacings, surface speeds and card wire positions of the combing-in cylinder and the regularisation cylinder are so selected that the card wires of the regularisation cylinder displace the fibres which are carried by the card wires of the combing-in cylinder, in the opposite direction to the direction of rotation of the combing-in cylinder, and thereby regularise that fibres, but do not substantially pick up said fibres.

The invention is based on the recognition that the empty gaps can be most rapidly eliminated by the surface of the combing-in cylinder being treated with a kind of comb. According to the invention, this comb comprises the card wires of the carding clothing of a single regularisation cylinder which co-operates with the combing-in cylinder, which card wires, by virtue of their position and relative speed, can neither pick up fibres from the surface of the combing-in cylinder nor supply fibres to the cylinder surface. The regularisation of the layer of fibres which is thus provided is so good as substantially to eliminate a gap which is produced by a needle, just in the first passage of the gap past the regularisation cylinder, because the card wires of the regularisation cylinder displace all fibres which are on the surface of the combing-in cylinder and thereby continuously spread fibres from regions of the cylinder surface which are covered with fibres, to those regions which are little covered or are not covered with fibres. By suitable selection of the different parameters, it is possible thus to provide that virtually no fibres are collected on the card wires of the regularisation cylinder, which operates as a comb.

Particular advantages of the invention are to be seen in the fact that, in comparison with the apparatus of DOS No. 25 24 491, there is a saving of one cylinder per system, or, when using two regularisation cylinders per system, the effect is doubled, while in comparison with the apparatus of U.S. Pat. No. 2,953,002, there is no collection of fibres which influence the production of patterned knitted goods or which have to be subjected to further treatment.

Further advantageous features of the invention are characterized in the subsidiary claims.

An embodiment of the invention is described in greater detail hereinafter with reference to the accompanying drawings, in which.

Figure 1:
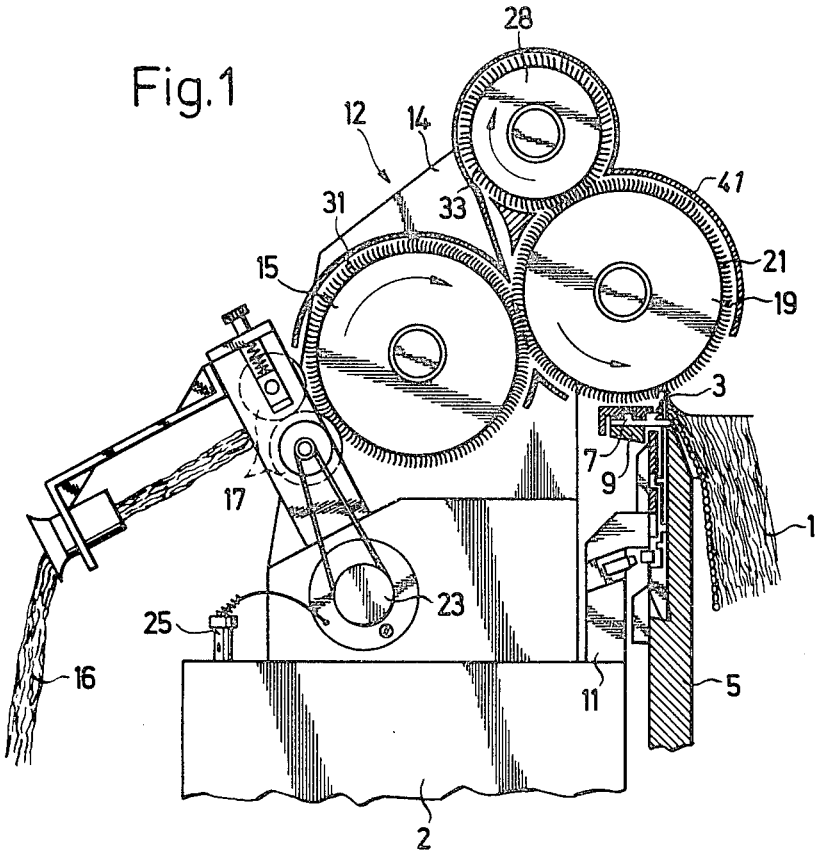
FIG 1 shows a circular knitting machine according to the invention.

Referring to FIG. 1, a circular knitting machine for producing a patterned stitchwork article 1 with combed-in fibres has a base plate 2 in which a needle cylinder 5 provided with knitting needles 3, and a sinker ring 9 provided with sinkers 7 are rotatably mounted. The knitting needles 3 and the sinkers 7 are controlled in the usual manner by cams, while a plurality of spaced knitting systems each having a patterning means 11 are arranged at the periphery of the needle cylinder 5. The knitting needles may be selected in accordance with the pattern, for knitting or not knitting, by means of the patterning means 11.

Also provided at each knitting system is a feed means 12 which is secured to a frame 14 and which provides for feeding fibres with a given attribute, for example colour, to the knitting needles which are selected for knitting purposes. For example, each feed means comprises a carding cylinder 15 with a carding clothing 31 to which fibres in the form of a silver 16 are fed by means of a pair of feed rolls 17, and a doffer or combing-in cylinder 19 having a carding clothing 21, by means of which the fibres removed from the carding cylinder 15 are offered to the knitting needles selected for the knitting operation. The region which is defined by the engagement of the carding cylinder 15 with the combing-in cylinder 19 forms the supply or feed position, while the region which is essentially indicated by the needles 3 represents the combing-in position.

The drive 23 for the feed rolls 17 is so controlled by means of a control device 25 that the fibres, as measured over relatively short periods of time, are transferred from the carding cylinder 15 on to the combing-in cylinder 19 in an amount such as is required by the pattern.

Circular knitting machines of the above-described kind are known for example from U.S. Pat. No. 2,953,002 and from DOS Nos. 23 43 886 and 25 24 491, and U.S. Pat. No. 3,709,002 to which reference is expressly made hereby.

Figure 2:
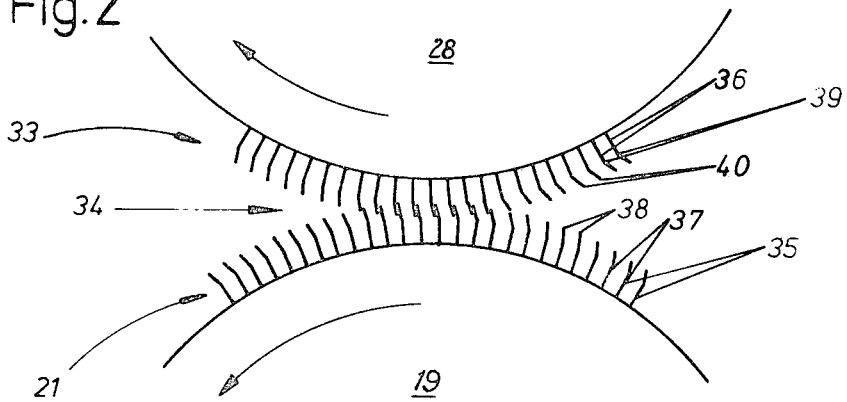
FIG. 2 shows a view on a greatly enlarged scale of the card wires of the combing-in cylinder and the card wires, which are engaged with the combing-in cylinder card wires, of the regularisation cylinder of the knitting machine of FIG. 1.

In accordance with the invention, as viewed in the direction of rotation of the combing-in cylinder, as indicated by an arrow, a single rotatable regularisation cylinder 28 having a carding clothing 33 acting as a comb is arranged after the combing-in position and before the feed position, or between the combing-in and feed positions. As shown in FIG. 2, the carding clothings 21 and 33 of the combing-in cylinder 19 and the regularisation cylinder 28 engage into each other along an engagement region 34 which extends over a number of card wires 35 and 36 respectively of the combing-in cylinder 19 and the regularisation cylinder 28. The card wires 35 of the combing-in cylinder 19 each have a respective bend 37 by means of which the ends 38 of the card wires 35 are bent in a forward direction, as viewed in the direction of rotation of the combing-in cylinder 19. The card wires 36 of the regularisation cylinder 28 each have a bend 39 by virtue of which the ends 40 of the card wires 36, a viewed in the direction of rotation of the regularisation cylinder 28, are bent rearwardly, i.e. in the opposite direction in relation to the card wires 35 of the combing-in cylinder 19, in the engagement region 34. Therefore, the ends 38 and 40 of the card wires 35 and 36 respectively are arranged substantially parallel to each other in the engagement region 34, as shown in FIG. 2.

The distance of the combing-in cylinder 19 from the regularisation cylinder 28 is so selected, in accordance with the invention, that at that location at which the surfaces of the two cylinders 19 and 28 are at the smallest spacing from each other, the bends 37 of the card wires 35 of the combing-in cylinder 19 are disposed substantially at the level of the ends 40 of the card wires 36 of the regularisation cylinder 28 and conversely the bends 39 of the card wires 36 of the regularisation cylinder 28 are disposed substantially at the level of the ends 38 of the card wires 35 of the combing-in cylinder 19, as is clearly shown in FIG. 2.

The surface speed of the combing-in cylinder 19 is greater than the surface speed of the regularisation cylinder 28. This provides that the card wires 36 of the regularisation cylinder 28 are overtaken by the card wires 35 of the combing-in cylinder 19, in the engagement region 34. The direction of rotation of the two cylinders 19 and 28 is indicated by arrows in FIGS. 1 and 2.

As far as possible or as far as is necessary, the surfaces of the carding cylinder 15, the combing-in cylinder 19 and the further cylinder 28 are covered with a cover plate 41.

By virtue of the above-described construction, surface speed and arrangement of the regularisation cylinder 28 and its carding clothing 33, the fibres which are entrained in the carding clothing 21 of the combing-in cylinder 19 are drawn flat in the engagement region 34, in the manner of a combing operation, are displaced in the opposite direction to the direction of rotation of the combing-in cylinder 19, and are thereby spread over subsequent surface areas. When this happens, the card wires 36 of the regularisation cylinder 28 hold or displace predominantly the fibres from those regions of the surface of the combing-in cylinder 19 on which there are comparatively large numbers of fibres, while conversely the fibres which are so held or displaced are peferentially re-deposited on those regions of the surface of the combing-in cylinder 19 on which there are comparatively few fibres. The result of this is that the fibres held or displaced by the card wires 36 of the regularisation cylinder 28 are deposited particularly where empty gaps have been formed on the surface of the combing-in cylinder 19.

Figure 3:
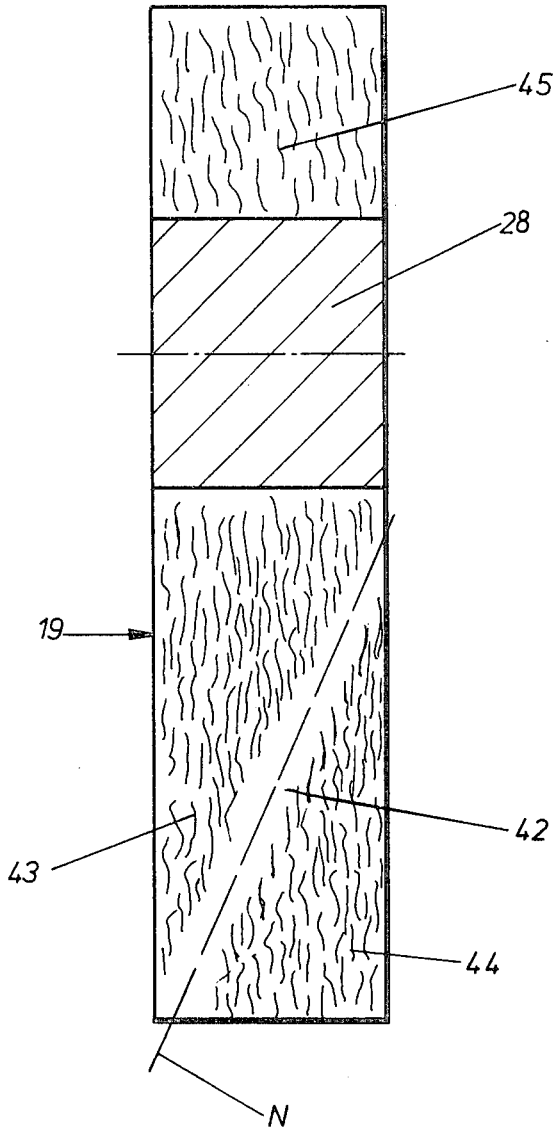
FIG. 3 shows a diagrammatic plan view of an enlarged scale of the combing-in cylinder and the regularisation of the circular knitting machine of FIG. 1.

FIG. 3 shows a plan view on to the surfaces of the combing-in cylinder 19 and the regularisation cylinder 28. After a knitting needle has passed through the carding clothing of the combing-in cylinder 19 along a line N, an empty gap 42 in which there are comparatively few fibres has been formed on the line N, whereas the adjacent regions 43 and 44 are covered with an unchanged layer of fibres. After the regions 42, 43 and 44 have moved past the regularisation cylinder 28 or the engagement region 34, the surface of the combing-in cylinder 19 has in contrast a region 45 of substantially uniform fibre density, as on the one hand the card wires 36 of the regularisation cylinder 28 have held fast or displaced fibres from the leading region 43, and have drawn such fibres into the gap 42, and on the other hand the fibres in the trailing region 44 have been handled in a corresponding manner and spread on to following regions (no longer visible in FIG. 3).

As the surface speed of the combing-in cylinder 19 is greater than the surface speed of the regularisation cylinder 28, the card wires 36 of the regularisation cylinder can in fact displace in the opposite direction to rotation of the combing-in cylinder, fibres which were entrained in the carding clothing of the combing-in cylinder 19, but it cannot pick up fibres itself, and thereby remove fibres from the surface of the combing-in cylinder 19. This effect is made even stronger by virtue of the fact that the ends 40 of the card wires 36 of the regularisation cylinder 28 are bent rearwardly as shown in FIG. 2 so that the fibres which they hold or displace fall off at the left-hand end of the engagement region 34, as viewed in FIG. 2, and are carried along by the forwardly bent, faster moving ends 38 of the card wires 35 of the combing-in cylinder 19.

The invention is not limited to the above-described embodiment but may be modified in various ways. In particular, two or more regularisation cylinders 28 having the same action may be associated with each combing-in cylinder 19, for the purposes of doubling or multiplying the regularisation effect. All the regularisation cylinders 28, as viewed in the direction of rotation of the combing-in cylinder 19, are advantageously to be arranged between the combing-in position and the feed position.

Corresponding regularisation cylinders may also be engaged with the carding cylinder 15, advantageously at positions which are between the feed rolls 17 and the combing-in cylinder 19, as viewed in the direction of rotation of the carding cylinder 15.

Furthermore, the invention is not limited to the bending of the card wires 36 of the regularisation cylinder 28, as shown in FIG. 2. The card wires 36 may also be bent in a forward direction or may be of a substantially straight construction throughout, if the ends 40 of the card wires extend in the engagement region 34 to about the bends 37 of the card wires 35 of the combing-in cylinder 19.

The surface speed of the combing-in cylinder 19 is preferably three to six times as high as the surface speed of the regularisation cylinder 28. A ratio of 4.5:0.8 m/min has been found particularly suitable.

The regularisation cylinders according to the invention, in conjunction with knitting machines for producing unpatterned articles with combed-in fibres, also provide particularly uniform fibre layers.

We claim:

1. A knitting machine having knitting needles for producing knitted goods having combed-in fibers, including at least one rotatable combing-in cylinder which is provided with a carding clothing, a feed position at which fibers are laid into the carding clothing of the combing-in cylinder, a combing-in position at which fibers are taken from the carding clothing of the combing-in cylinder by the knitting needles, and at least one rotatable regularization cylinder which also has a carding clothing, which cooperates with the combing-in cylinder for rendering uniform the density of the fibers carried thereon, wherein the two carding clothings have resilient card wires being in engagement along an engagement region and wherein the relative spacings, surface speeds and card wire positions of the combing-in cylinder and the regularization cylinder are so selected that the card wires of the regularization cylinder comb and displace the fibers which are carried by the card wires of the combing-in cylinder, in the opposite direction to the direction of rotation of the combing-in cylinder and thereby regularize said fibers, but do not substantially pick up said fibers.

2. A knitting machine according to claim 1, wherein the regularization cylinder is arranged, in the direction or rotation of the combing-in cylinder, after the combing-in position and before the feed position.

3. A knitting machine according to claim 1, wherein said combing-in cylinder and said regularization cylinder travel in the same peripheral direction within the engagement region and wherein the surface speed of the combing-in cylinder is greater than the surface speed of the regularization cylinder.

4. A knitting machine according to claim 1, wherein the card wires of said combing-in cylinder and said regularization cylinder are bent such that the card wires of the combing-in cylinder are bent in the opposite direction in relation to the card wires of the regularization cylinder, in the engagement region.

5. A knitting machine according to claim 4, wherein the combing-in cylinder and the regularization cylinder are spaced such that at the position at which the surfaces of these two cylinders are at their smallest spacing apart, the bends of the respective card wires of one cylinder are arranged approximately at the level of the ends of the card wires of the other cylinder.

6. A knitting machine according to claim 1, further having a patterning means for selecting the knitting needles in accordance with a pattern, at the combing-in position.

7. A knitting machine according to claim 6, further having a means for controlling, in accordance with the pattern, the amount of fiber fed to the combing-in cylinder.

* * * * *